United States Patent [19]

Auschrat

[11] Patent Number: 4,685,865

[45] Date of Patent: Aug. 11, 1987

[54] LIQUID RING COMPRESSOR HAVING OPENINGS IN HOUSING FOR EMPTYING LIQUID DURING STOPPAGE

[75] Inventor: Siegfried Auschrat, Heiligenstedten, Fed. Rep. of Germany

[73] Assignee: Sihi GmbH & Co. KG, Itzehoe, Fed. Rep. of Germany

[21] Appl. No.: 758,282

[22] Filed: Jul. 24, 1985

[30] Foreign Application Priority Data

Jul. 26, 1984 [DE] Fed. Rep. of Germany ..... 3427628

[51] Int. Cl.[4] ..... F04C 19/00

[52] U.S. Cl. ..... 417/68; 417/244; 417/434

[58] Field of Search ..... 417/68, 69, 244, 434

[56] References Cited

U.S. PATENT DOCUMENTS

| | | | |
|---|---|---|---|
| 1,662,250 | 3/1928 | Jennings | 417/68 X |
| 1,680,906 | 8/1928 | Neumann | 417/69 |
| 2,124,181 | 7/1938 | Borgerd et al. | 417/68 |
| 2,145,644 | 1/1939 | Brace | 417/68 |
| 3,108,738 | 6/1963 | Luhmann | 417/68 |
| 3,275,222 | 11/1966 | Meyer | 417/381 |
| 4,273,515 | 6/1981 | Fitch | 417/68 X |

FOREIGN PATENT DOCUMENTS

| | | | |
|---|---|---|---|
| 923571 | 2/1955 | Fed. Rep. of Germany | 417/68 |
| 961653 | 4/1957 | Fed. Rep. of Germany | 417/68 |
| 749637 | 5/1956 | United Kingdom | 417/68 |
| 858422 | 1/1961 | United Kingdom | 417/68 |

*Primary Examiner*—Carlton R. Croyle
*Assistant Examiner*—Paul F. Neils
*Attorney, Agent, or Firm*—Chilton, Alix & Van Kirk

[57] ABSTRACT

The invention relates to a liquid ring compressor in which only one central emptying opening is provided to the outside per compressor stage. It is ensured by means of appropriate connections of the chambers pertaining to each compressor stage that the entire auxiliary/operating liquid can flow out of the compressor through the central emptying opening (s) when the compressor is stopped.

10 Claims, 6 Drawing Figures

Figure 1:
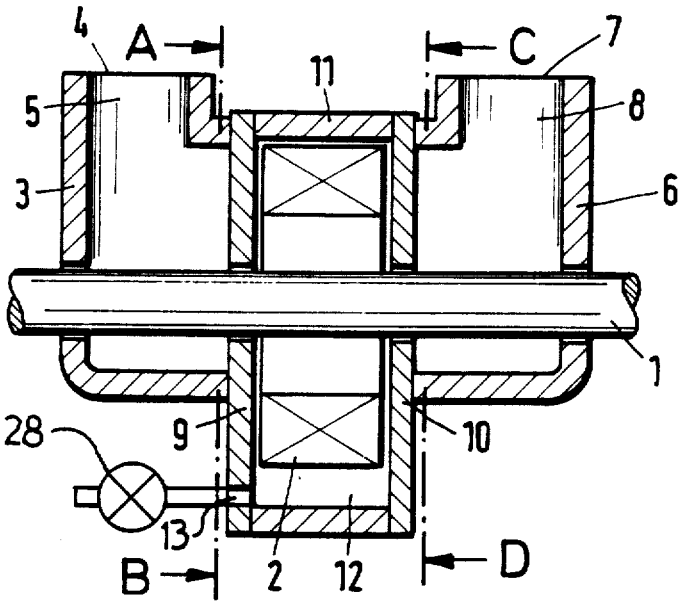

LIQUID RING COMPRESSOR HAVING OPENINGS IN HOUSING FOR EMPTYING LIQUID DURING STOPPAGE

DESCRIPTION

The invention relates to a liquid-ring compressor having a horizontal shaft, suction and pressure chambers arranged at the side of a delivery chamber and openings for emptying these chambers.

As is known, these compressors acquire an auxiliary fluid for operation, of which a portion remains in the compressor even after the compressor is switched off and stopped. This is necessary in order to be able to start up the compressor again at a later time. However, there are also applications in which it is desirable to remove the auxiliary liquid located in the compressor from the compressor housing during the stoppage periods. This is necessary, for example, when the compressor is working in spaces with such a low temperature level that the operating or auxiliary fluid remaining in it would freeze during stoppage and in doing so possibly destroy the compressor housing. A further conceivable reason for removing the auxiliary or operating liquid from the compressor housing can be that the fluid is very aggressive and chemically attacks the compressor material even during stoppage. It is also conceivable that various media will be delivered by one compressor and also different auxiliary liquid are to be used for different delivery media. These three possibilities are only mentioned here by way of example; other cases are conceivable in which removal of the operating liquid from the compressor housing is desirable or necessary.

Known liquid-ring compressors have the disadvantage that, in order to let the liquid completely out of the compressor, a plurality of emptying openings at the housing must be provided and opened, and in fact, at every suction, deliver and pressure chamber of the compressor, because otherwise more or less considerable operating liquid residues remain behind in certain geodetically deep lying areas of these chambers.

This can mean, for example, that, in a simple, single-stage compressor having an inflow and an outflow on both sides to the delivery chamber of the compressor, that is, having one suction and pressure chamber each on each compressor side, five emptying openings must be provided and also opened in the event of emptying.

To avoid this disadvantage, it is proposeda ccording to the invention to provide only one common emptying opening for all chambers associated with one stage and to connect the suction and the pressure chamber of each compressor stage to the delivery chamber of the compressor stage in each case at the geodetically deepest located point of the chamber and to arrange the emptying opening at the geodetically deepest point of the compressor stage. By this means, all fluid from the chambers pertaining to each compressor stage is in connecting with the geodetically deepest point of the compressor stage and also the entire auxiliary liquid located in the compressor stage can flow out through the emptying opening arranged at the geodetically deepest point of the stage.

The emptying opening is expediently arranged at the delivery stage; but it is also possible to provide it at the suction or pressure chamber, provided the latter is located at least as deep as the delivery chamber.

In a favorable embodiment of the invention, the suction chamber of the compressor stage is terminated at the bottom by a wall directly adjoining the geodetically deepest point of the suction passage between the suction and delivery chamber. At the same time, the deep lying pont of the suction passage itself forms the geodetically deepest located connection between the suction chamber and the delivery chamber of the compressor stage.

If the suction and delivery chamber of the compressor are connected by an, if necessary, additional bore it is advantageous to arrange this bore in the geodetically deepest located point of the suction chamber in such a way that it connects the gas zone of the delivery chamber to the suction chamber during operation of the compressor. Because of the arrangement in this area, the delivery output of the compressor in normal operation is not impaired.

Just as described for the suction chamber, the pressure chamber, according to the invention, can be terminated at the bottom by a wall which is geodetically arranged between the delivery and pressure chamber directly beneath the pressure passage or the bore, slots or valves pertaining to the pressure passage. In this connection, too, the deepest located point of the passage or the associated bores or valves again acts as the requisite, geodetically deep lying connection between the pressure chamber and the delivery stage, and if necessary a further connection can be dispensed with.

According to the invention, just as between the suction chamber and the delivery chamber of the compressor, a connecting bore to the delivery chamber of the compressor can also be arranged at the geodetically deepest located point of the pressure chamber.

If a compressor contains chambers which are both a pressure chamber of a preceding compressor stage and a suction chamber of a subsequent compressor stage, it is proposed according to the invention to arrange the geodetically deep lying connection in each case between this chamber and the delivery chamber of the subsequent stage. At the same time, it has been shown that the connection can be formed most simply without influencing the compressor output.

In a further embodiment of the inventive idea, it is proposed to arrange the connecting bores between the suction and delivery chamber or pressure and delivery chamber in troughs or pockets of these chambers drawn geodetically downwards. By this means, all chambers are emptied of auxiliary or operating liquid particularly efficiently, which is particularly advantageous when, for example, the media would lead a corrosive attack on the compressor materials during stoppage.

Finally, it is proposed according to the invention, in the case of multi-stage compressors, to connect the emptying openings of the various compressor stages by a common line with shut-off members arranged in this line between the compressor stages.

By appropriately coupling these shut-off members to an existing central emptying opening, simple and problem-free emptying of even multi-stage compressors can be achieved by only one central emptying discharge. However, shutting off the connecting line during operation of the compressor is necessary to prevent an overflow of fluid between the various compressor stages and thus also to prevent a corresponding reduction in output.

Figure 2:
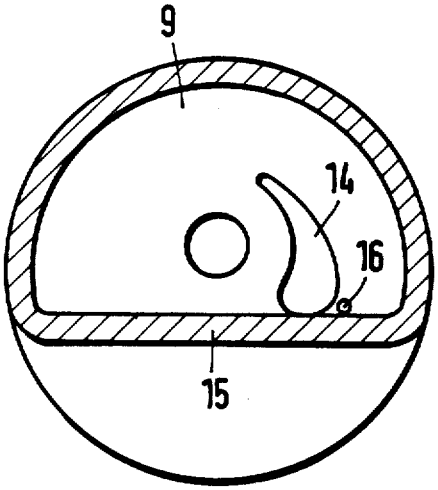
Figure 3:
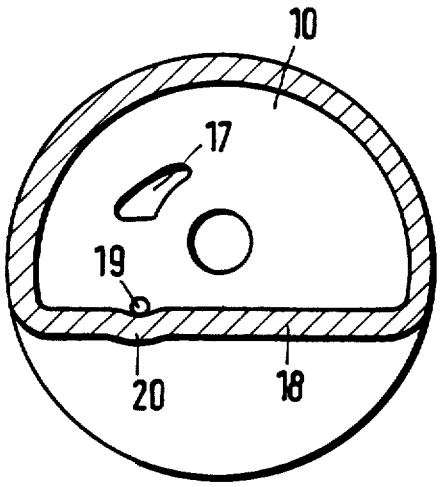
Figure 4:
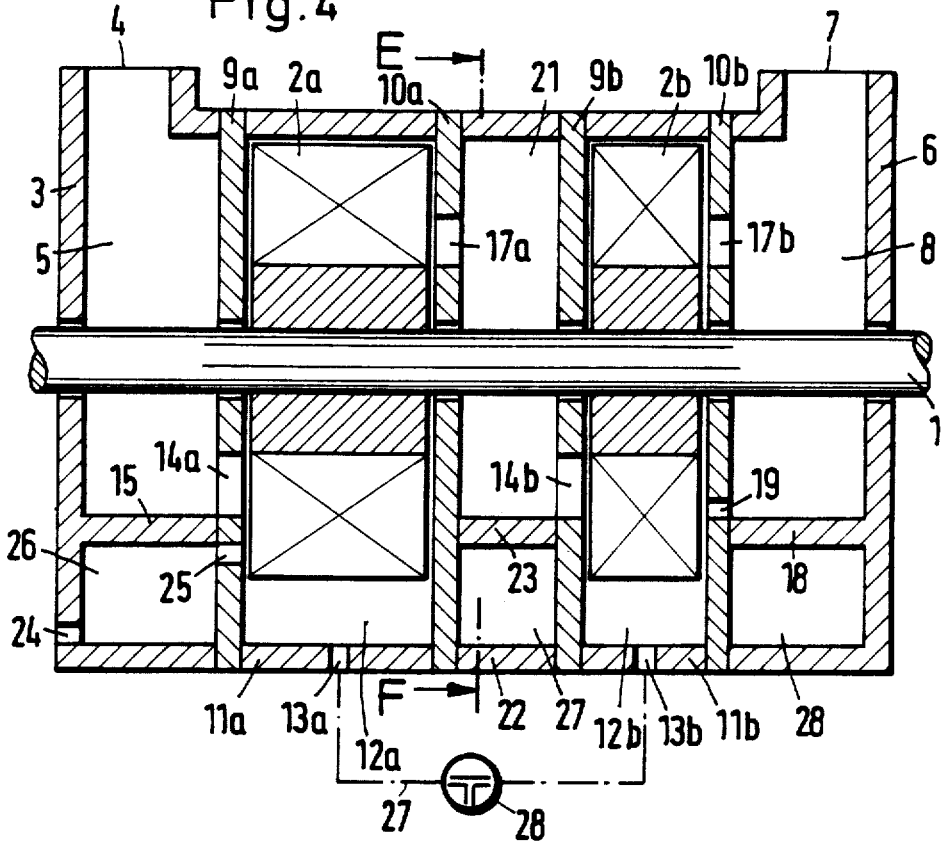
Figure 5:
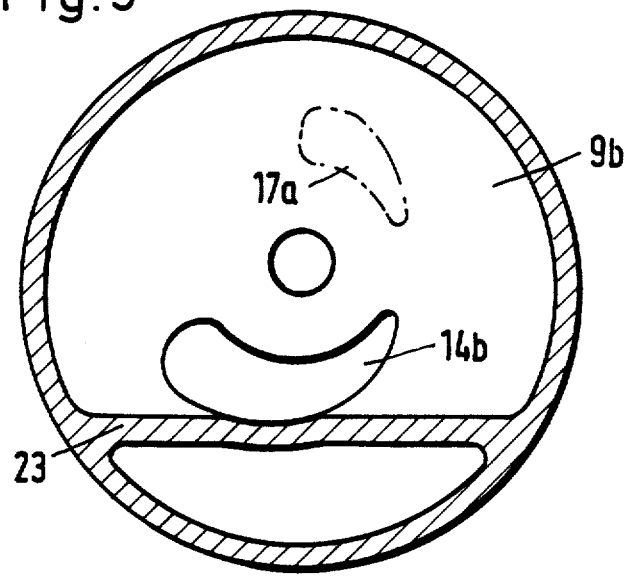
Figure 6:
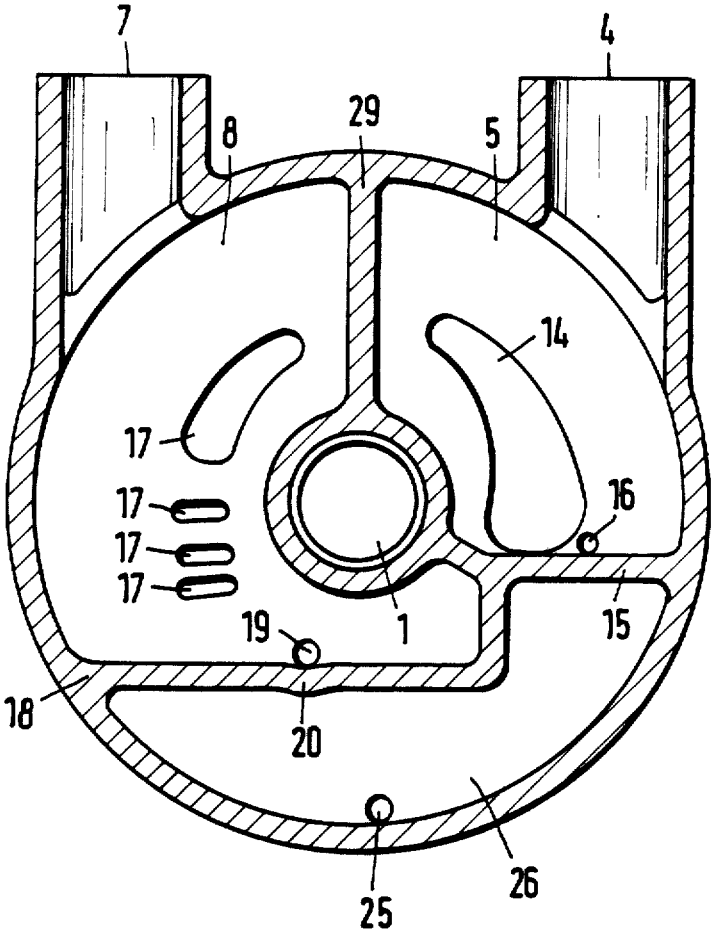

The invention is described by way of example with reference to the attached drawings, wherein:

FIG. 1 shows a schematic longitudinal section through a single-stage compressor, FIG. 2 shows a cross-section along line A-B through the suction chamber of the compressor according to FIG. 1, FIG. 3 shows a cross-section along line C-D through the pressure chamber of the compressor according to FIG. 1, FIG. 4 shows a schematic longitudinal section through a two-stage liquid-ring compressor, FIG. 5 shows a cross-section along line E-F in FIG. 4, FIG. 6 shows a schematic cross-section through the suction and pressure chamber of a compressor in which these two chambers are arranged on the same side.

In FIG. 1, the impeller 2 is fixed on the shaft 1. The suction-side compressor inlet 4 to the suction chamber 5 of the compressor stage is at the suction cover 3. The pressure connecting piece 7 of the compressor together with the pressure chamber 8 is located at the pressure cover 6. The impeller runs between the control disk 9 on the suction side and the control disk 10 on he pressure side which, together with the center body 11, form the delivery chamber 12 of the compressor.

The single openign 13 for emptying the compressor stage to the outside is provided at this delivery chamber 12. A shutoff valve 28 is provided for selectively opening the opening 13 to empty the working liquid from the compressor to the outside when the compressor is not in use, of for closing the opening when the compressor is in use.

FIG. 2 shows a plan view of the suction-side control disk 9 out of the suction chamber 5 of the compressor. The medium passes from the suction chamber 5 over into the delivery chamber 12 through the suction passage 14 in the control disk 9. The suction chamber 5 is terminated at the bottom by a wall 15 which directly adjoins the geodetically deepest located point of the suction passage 14. Also shown here is how a connecting bore 16 in the control disk 9 connects the suction chamber 5 to the delivery chamber 12 at the geodetically deepest located point of the suction chamber, with this bore being arranged in such a way that it connects the gas zone of the delivery chamber 12 to the suction chamber 5 during operation of the compressor.

FIG. 3 shows a view from the pressure chamber 8 of the compressor up to the pressure-side control disk 10. Located in the latter is the pressure passage 17 through which the delivery medium and a portion of the fluid flows from the delivery chamber 12 of the compressor into the pressure chamber 8. The pressure chamber 8 itself is terminated at the bottom by a wall 18, at the geodetically deepest located point of which a bore 19 additionally connects the pressure chamber 8 to the delivery chamber 12 of the compressor. Here, the bore is located in a trough or pocket 20 of the wall 18, which trough or pocket 18 is drawn geodetically downwards.

A two-stage compressor is shown in FIG. 4, with the two impellers 2*a* of the first stage and 2*b* of the second stage being fixed on the shaft 1. The suction connecting piece 4 is located at the suction cover 3 of the compressor and the suction chamber 5 is located in the suction cover 3. The delivery chamber 12*a* of the first compressor stage is terminated by the control disk 9*a* on the suction side, the control disk 10*a* on the pressure side and by the center body 11*a*. The delivery chamber 12*b* of the second stage is terminated by the control disk 9*b* on the suction side, the control disk 10*b* on the pressure side and by the center body 11*b*.

The pressure chamber 8 of the compressor is terminated by the pressure cover 6 and the pressure connecting piece 7 of the compressor is arranged at the pressure chamber 8. The delivery medium flows from the suction chamber 5 to the compressor through the suction passage 14*a* of the first stage into the delivery chamber 12*a*, leaves this stage together with a portion of the auxiliary fluid through the pressure slot 17*a* and flows into the chamber 21 which at the same time is the pressure chamber of the first compressor stage and the suction chamber of the following compressor stage. This chamber 21 is enclosed by the control disk 10*a* of the first stage, the control disk 9*b* of the second stage and the compressor housing part 22. The medium flows from this chamber 21 together with a portion of the auxiliary liquid through the suction passage 14*b* in the delivery chamber 12*b* of the second stage, leaves the latter again through the pressure passage 17*b* in the control disk 10*b* and flows through the pressure chamber 8 into the pressure connecting piece 7 of the compressor. The suction chamber 5 of the pump is terminated at the bottom, as in FIG. 2, by a wall 15 which, at its deepest lying location, touches the geodetically deepest lying point of the suction slot 14*a* in the control disk 9*a*. In the same way, according to FIG. 5, the wall 23 is arranged as a termination of the chamber 21, with the wall here touching the deepest point of the suction slot 14*b* in the control disk 9*b* of the second compressor stage. In this way, a geodetically deep lying connection from the chamber 21 to the delivery chamber 12*b* of the subsequent stage is provided. The pressure chamber 8, as in FIG. 3, is connected at the geodetically deepest located point by the bore 19 to the delivery chamber 12*b* of the second compressor stage, with the pressure chamber 8 being terminated at the bottom by the wall 18. The bore 13*a* is used for the central emptying of the first compressor stage to the outside and the bore 13*b* is used for the second compressor stage. As indicated in FIG. 4 by a chain-dotted line, the two bores can be connected by an additional line 27 which contains a shut-off member 28, so that the two bores 13*a* and 13*b* can be shut off against one another during compressor operation. For this purpose, a combined shut-off member is expediently provided, for example, a three-way cock, which, in a first postiion, releases to the outside the connection of the bore 13*a* and 13*b* and also an opening, and closes all of these in a second position.

The required operating liquid can be supplied to the compressor through a housing bore 24, via the chamber 26 arranged beneath the suction chamber 5 and via a bore 25 in the control disk 9*a*. The chamber 26, as well as the other chambers 27 and 28 located at the side of the compressor stage, can also be used in other ways, for example for collecting dirt from the delivery chambers 12*a* and 12*b*.

The pressure passage 17*a* of the first compressor stage located in front of the cutting plane is shown as a chain-dotted line in FIG. 5. The pressure passage 17*a* of the first compressor stage serves as the suction passage of the second compressor stage.

In the embodiment presupposed in FIG. 6, the suction chamber 5 and the pressure chamber 8 are located in the same housing cover on one side of the delivery chamber of the compressor. The figure shows a cross-section through this housing cover in the direction of the control disk. The medium enters into the suction chamber 5 through the suction connecting piece 4 and flows through the suction passage 14 into the delivery chamber of the compressor. The delivery medium, together with a portion of the liquid, flows into the pressure chamber 8 through the pressure opening 17, subdivided into several partial openings, and leaves the compressor through the pressure connecting piece 7. The suction and pressure chambers are separated from one another by the wall 29. The suction chamber is terminated at the bottom by the wall 15 which touches the geodetically deepest located point of the suction passage 14. Here, moreover, a connecting bore 16 to the delivery chamber of the pump is provided at the geodetically deepest located point of the suction chamber 5. The pressure chamber 8 is terminated at the bottom by the wall 18, and the connecting bore 19 between the pressure chamber 8 and the delivery chamber of the compressor is arranged in a pocket or trough 20 which is drawn downwards and forms the geodetically deepest location of the pressure chamber. The requisite operating liquid can be supplied to the compressor via the chamber 26 through the bore 25 in the control disk.

The embodiment possiblities shown are only a few examples of many possible variants of the invention.

I claim:

1. A liquid ring compresor having a horizontal shaft and at least one stage, each stage including suction and pressure chambers arranged at the side of a delivery chamber, a suction passage leading from the suction chamber to the delivery chamber, a pressure passage leading from the delivery chamber to the pressure chamber, and an impeller located within the delivery chamber and driven by the shaft chracterized in that:

only one common emptying opening (13, 13*a*, 13*b*) is provided for each stage for all chambers associated with this stage;

both the suction chamber (5, 21) and the pressure chamber (8, 21) of each compressor stage are in each case fluidly connected at their geodetically deepest located point to the delivery chamber (12, 12*a*, 12*b*) of the respective stage such that all liquid in the stage has a fluid path to the geodetically deepest point of the stage;

the emptying opening (13, 13*a*, 13*b*) is arranged at the geodetically deepest point of the respective stage; and means are provided for selectively opening the emptying opening (13, 13*a*, 13*b*) to drain all the liquid from every chamber in the respective stage when the compressor is not in use, and for closing the opening when the compressor is in use.

2. A liquid ring compressor as claimed in claim 1, wherein the emptying opening (13,13*a*,13*b*) is provided at the delivery chamber (12,12*a*,12*b*).

3. A liquid compressor as claimed in claim 2, wherein the suction chamber (5,21) of each compressor stage is terminated at the bottom by a wall (15,23) directly adjoining the geodetically deepest point of the suction passage (14,14*a*,14*b*) between the suction and delivery chamber.

4. A liquid-ring compressor as claimed in claimed 2 or 3, wherein between the suction and delivery chamber of each compressor stage, a connecting bore (16) is arranged at the geodetically deepest located point of the suction chamber, which bore (16) connects the gas zone of the delivery chamber to the suction chamber during operation of the compressor and provides said fluid drainage connection between the suction chamber and the delivery chamber when the compressor is not in use.

5. A liquid-ring compressor as claimed in one of claims 1, 2 or 3 wherein the pressure chamber (9,21) is terminated at the bottom by a wall (18,23) which is geodetically arranged between the delivery and pressure chamber directly beneath any passages fluidly connected between the delivery and pressure chambers.

6. A liquid ring compressor as claimed in claims 4 or 6, wherein, between the suction and delivery chamber of each compressor stage, a first connecting bore (16) is arranged at the geodetically deepest located point of the suction chamber, and wherein a second connecting bore (19) between the pressure and delivery chamber of each compressor stage is arranged at the geodetically deepest located point of each pressure chamber, and wherein the connecting bore (16, 19) are arranged in troughs (20) formed in the walls (15, 18, 23) to provide said lfuid drainage connections when the compressor is not in use.

7. A liquid-ring compressor as claimed in one of claims 1, 2 or 3, wherein a connecting bore (19) to the associated delivery chamber of the compressor is arranged at the geodetically deepest located point of each pressure chamber (8) to provide said fluid drainage connection between the pressure chamber and the delivery chamber when the compressor is not in use.

8. A liquid-ring compressor as claimed in one of claims 5 or 7, wherein the connecting bores (16,19) between the suction and delivery chamber or the pressure and delivery chamber are arranged in troughs (20) or pockets of these chambers drawn geodetically downwards.

9. A liquid-ring compressor as claimed in one of claims 1, 2 or 3, wherein from one chamber (21), which is the pressure chamber of a preceding compressor stage and at the same time the suction chamber of a subsequent compressor stage, the geodetically deep lying connection leads to the delivery chamber (12*b*) of the subsequent stage.

10. A liquid-ring compressor as claimed in one of cliams 1, 2 or 3, wherein the emptying openings (13*a*,13*b*) of various compressor stages are connected bya common line (27) with at least one shut-off member (28) arranged in this line.

* * * * *

UNITED STATES PATENT AND TRADEMARK OFFICE

CERTIFICATE OF CORRECTION

PATENT NO. : 4,685,865

DATED : August 11, 1987

INVENTOR(S) : Siegfried Auschrat

It is certified that error appears in the above-indentified patent and that said Letters Patent is hereby corrected as shown below:

Column 5, line 53, after "liquid" insert -- -ring --.

Column 6, line 14, "(9,21)" should be --(8,21)--;

line 27, "bore" should be --bores--;
line 38, "5" should be --4--;
line 53, "bya" should be --by a--.

Signed and Sealed this

Tenth Day of December, 1996

*Attest:*

Bruce Lehman

BRUCE LEHMAN

*Attesting Officer*

*Commissioner of Patents and Trademarks*